US007506860B2

(12) United States Patent
Stull

(10) Patent No.: US 7,506,860 B2
(45) Date of Patent: Mar. 24, 2009

(54) TEMPORARY GATE SUPPORT DEVICE

(75) Inventor: Edward J. Stull, Oxford, MI (US)

(73) Assignee: Turnstyle Intellectual Property, LLC, Georgetown, SC (US)

( * ) Notice: Subject to any disclaimer, the term of this patent is extended or adjusted under 35 U.S.C. 154(b) by 45 days.

(21) Appl. No.: 11/697,327

(22) Filed: Apr. 6, 2007

(65) Prior Publication Data

US 2007/0235151 A1 Oct. 11, 2007

Related U.S. Application Data

(60) Provisional application No. 60/790,442, filed on Apr. 7, 2006.

(51) Int. Cl.
*E04H 17/16* (2006.01)

(52) U.S. Cl. ..... 256/73; 256/26

(58) Field of Classification Search ..... 256/24–31, 256/73, DIG. 5; 49/333, 365, 386
See application file for complete search history.

(56) References Cited

U.S. PATENT DOCUMENTS

| | | | | | |
|---|---|---|---|---|---|
| 28,205 | A | | 5/1860 | Sill | |
| 82,648 | A | * | 9/1868 | Smith | 49/386 |
| 163,084 | A | | 5/1875 | Krom | |
| 203,575 | A | | 5/1878 | Arnn | |
| 326,548 | A | | 9/1885 | Crowfoot | |
| 363,964 | A | | 5/1887 | Philpott | |
| 398,718 | A | * | 2/1889 | Ford | 49/46 |
| 447,819 | A | * | 3/1891 | Gorham | 49/237 |
| 571,237 | A | | 11/1896 | Philpott | |
| 780,623 | A | * | 1/1905 | Sisk | 49/239 |
| 920,305 | A | | 5/1909 | Finch | |
| 933,677 | A | | 9/1909 | Smith | |
| 1,221,796 | A | * | 4/1917 | Egbert | 312/249.2 |
| 1,383,961 | A | * | 7/1921 | Melugin | 16/314 |
| 1,462,766 | A | * | 7/1923 | Post | 49/253 |
| 1,494,911 | A | * | 5/1924 | Heselschwerdt | 160/377 |
| 1,540,490 | A | * | 6/1925 | Mertel | 49/381 |
| 1,594,260 | A | * | 7/1926 | Herr | 49/46 |
| 1,630,200 | A | | 5/1927 | Merrill | |

(Continued)

FOREIGN PATENT DOCUMENTS

| | | |
|---|---|---|
| DE | 20121216 | 6/2002 |

(Continued)

OTHER PUBLICATIONS

International Search Report and Written Opinion mailed on Oct. 1, 2007.

(Continued)

*Primary Examiner*—Daniel P Stodola
*Assistant Examiner*—Joshua T Kennedy
(74) *Attorney, Agent, or Firm*—Carlson, Gaskey & Olds

(57) ABSTRACT

An example temporary gate assembly includes a support mounted within the ground and a rotation mechanism that supports rotation of cross-members about the support. The gate assembly includes a fixed support that is mounted within the ground by way of a mounting flange. The mounting flange prevents twisting of the support rod during gate operation. Bottom cross-members are attached to a bottom support bearing that is rotatable about the support.

14 Claims, 4 Drawing Sheets

U.S. PATENT DOCUMENTS

| | | | | | |
|---|---|---|---|---|---|
| 1,891,739 | A | * | 12/1932 | Wenger | 246/126 |
| 2,151,052 | A | * | 3/1939 | Smart et al. | 49/239 |
| 2,181,464 | A | * | 11/1939 | Renner | 49/386 |
| 2,251,482 | A | * | 8/1941 | Curtiss, Jr. | 16/275 |
| 2,924,843 | A | * | 2/1960 | Tykeson | 16/279 |
| 3,626,547 | A | * | 12/1971 | Werner | 16/314 |
| 4,122,630 | A | * | 10/1978 | Parisien | 49/386 |
| 4,472,908 | A | | 9/1984 | Wanzl et al. | |
| 4,572,595 | A | * | 2/1986 | Craig | 312/305 |
| 4,665,650 | A | * | 5/1987 | Hall | 49/334 |
| 5,035,082 | A | | 7/1991 | Butler | |
| 5,133,152 | A | * | 7/1992 | Grancagnolo | 49/239 |
| 5,138,796 | A | * | 8/1992 | Grainger | 49/238 |
| 5,277,488 | A | | 1/1994 | Cleary et al. | |
| 5,373,664 | A | * | 12/1994 | Butler | 49/358 |
| 5,557,889 | A | * | 9/1996 | Sharp | 49/386 |
| 5,564,367 | A | * | 10/1996 | Boyanton | 119/474 |
| 2005/0156149 | A1 | * | 7/2005 | Stull | 256/73 |

FOREIGN PATENT DOCUMENTS

| | | |
|---|---|---|
| EP | 0152210 | 8/1985 |
| EP | 0743464 | 11/1996 |
| GB | 585176 | 1/1947 |
| WO | 2005/073494 | 8/2005 |

OTHER PUBLICATIONS

International Search Report dated May 12, 2005.

* cited by examiner

TEMPORARY GATE SUPPORT DEVICE

CROSS REFERENCE TO RELATED APPLICATION

The application claims priority to U.S. Provisional Application No. 60/790,442 which was filed on Apr. 7, 2006.

BACKGROUND OF THE INVENTION

This invention generally relates to a temporary gate assembly. More particularly, this invention relates to a rotatable support mechanism for supporting a temporary gate assembly Temporary fencing is often utilized to restrict access to areas such as construction sites, or special events. The temporary fencing is typically constructed of a flexible material that is easily set up and stored. The temporary fencing is in many instances a plastic mesh material that is strung between stakes or poles stuck in to the ground. The poles are usually simply supported in the ground and are not intended to support anything more than the flexible temporary fencing material.

Disadvantageously, the temporary nature of such fencing prevents the use of a gate structure. An opening is typically created by simply rolling up and moving the fence material out of the way. However, in many instances such actions are not desirable and do not adequately meet the desired purpose of restricting access provided by the temporary fence.

SUMMARY OF THE INVENTION

An example temporary gate assembly includes a support mounted within the ground and a rotation mechanism that supports rotation of cross-members about the support.

The example gate assembly provides for control of movement through a temporary fence. The gate assembly includes a fixed support that is mounted within the ground by way of a mounting flange. The mounting flange prevents twisting of the support rod during gate operation. Bottom cross-members are attached to a bottom support bearing that is rotatable about the support. The rotational mechanism rotates relative to the support and supports upper cross members. Pushing the upper cross-members causes rotation of the gate assembly to allow movement through the fence.

The example rotation mechanism operates by supporting the weight of the gate assembly on a ball bearing supported atop the post. A rotatable sleeve includes a bearing surface defining an inner surface that maintains a desired alignment between the fixed plate and the rotatable member. The bearing surface is a low friction material that facilitates rotation of the sleeve relative to the post. The ball bearing provides support for the rotatable portion of the gate assembly while also facilitating rotation of the gate assembly.

These and other features of the present invention can be best understood from the following specification and drawings, the following of which is a brief description.

DETAILED DESCRIPTION OF THE PREFERRED EMBODIMENT

Figure 1:
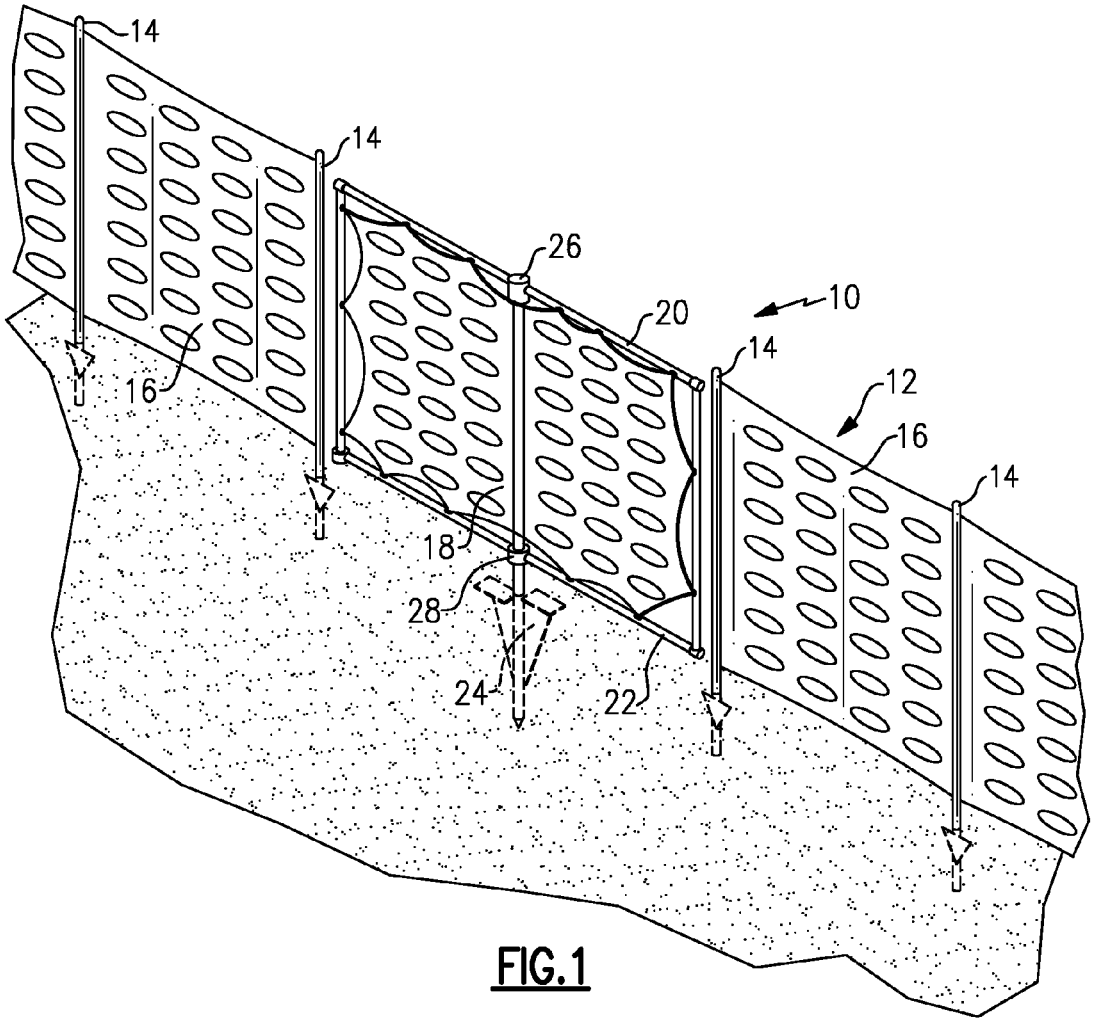
FIG. 1 is a perspective view of a temporary fence including an example temporary gate assembly according to this invention.

Referring to FIG. 1, a gate assembly 10 provides for control of movement through a temporary fence 12. The temporary fence 12 includes poles 14 received within the ground to support flexible fencing material 16. The flexible fencing material 16 can include plastic mesh fencing, metal mesh or any other material utilized for a temporary fence.

The gate assembly 10, includes a top cross member 20 and a bottom cross member 22 attached to each other at each end of the gate assembly 10 by a connection rod 23. The top cross-member 20, bottom cross-member 22 and the connection rod 23 support the flexible fencing 16. The gate assembly 10 includes a fixed support 18 that is mounted within the ground by way of a mounting flange 24. The mounting flange 24 prevents twisting of the support rod 18 during gate operation. The mounting flange 25 is staked into the ground along with a portion of the support rod 18 to temporarily secure the gate assembly within a desired opening.

The bottom cross-members 22 are attached to a bottom support bearing 28 that is rotatable about the support 18. The support bearing 28 includes material with low friction properties to support rotation. The support 18 includes a rotational mechanism 26. The rotational mechanism 26 rotates relative to the support 18 and supports the upper cross members 20. Pushing the upper cross-members causes rotation of the gate assembly 10 to allow movement past the fence 12.

Figure 2:
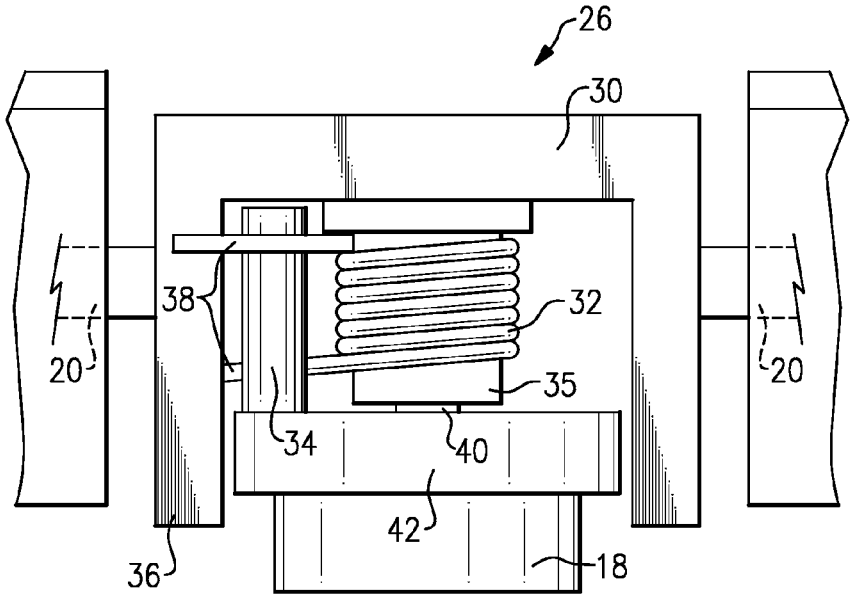
FIG. 2 is a sectional view of an example rotational support mechanism according to this invention.

Referring to FIG. 2, the support 18 includes a fixed support plate 42. Extending upward from the support plate 42 is a shaft 40. The shaft 40 is received within a rotatable member 30. The rotatable member 30 defines an internal space within which a spring 32 is supported about a sleeve 35. The spring 32 is supported on the sleeve 35 and rotates the gate assembly 10 back to a desired position from any open position. The spring 32 includes arms 38 that engage legs 34, 36. Rotation of the gate assembly 10, and thereby the rotatable member 30 and the sleeve 35 causes the arms 38 to engage one of the legs 34, 36. This engagement progressively loads the spring 32 in such a manner as to move the gate assembly 10 back to the desired position once released.

Figure 3:
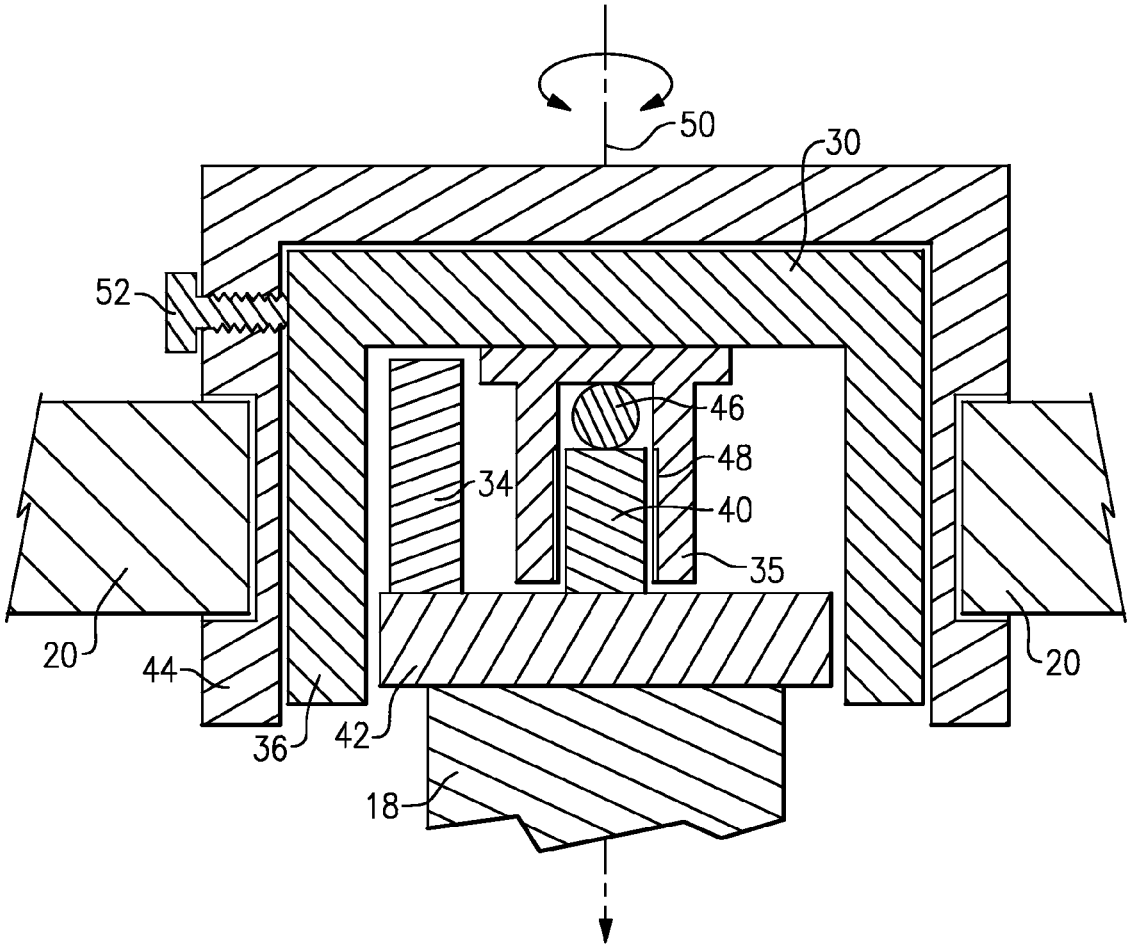
FIG. 3 is a cross-sectional view of the example rotational support mechanism.

Referring to FIG. 3, the rotation mechanism operates by supporting the weight of the gate assembly 10 on a ball bearing 46 supported atop the post 40. The rotatable sleeve 35 includes a bearing surface 48 defining an inner surface of the sleeve 35 to maintain a desired alignment between the fixed plate 42 and the rotatable member 30. The bearing surface 48 is a low friction material that facilitates rotation of the sleeve 35 relative to the post 40. The ball bearing 46 provides support for the rotatable portion of the gate assembly 10 while also facilitating rotation of the gate assembly.

Figure 4:
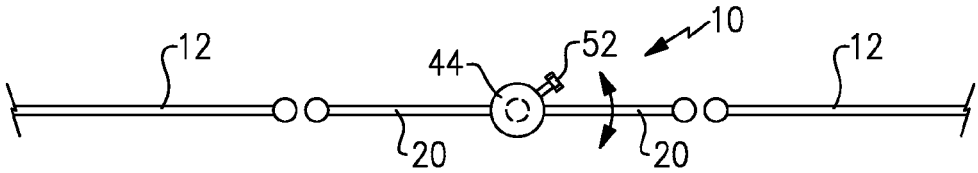
FIG. 4 is a schematic top view of a gate assembly according to this invention.

Referring to FIG. 4, with continuing reference to FIG. 3, the gate assembly also includes an adjustment cap 44 that fits onto the rotatable member 30. The adjustment cap 44 provides for alignment of the gate assembly 10 within the fence opening. The cap 44 is rotatable relative to the rotatable member 36 to align the gate assembly 10 as desired within an opening in the fence 12. A fastener 52 is then tightened to secure the alignment cap 44 to the rotatable member 36 so that both the alignment cap 44 and the rotatable member 36 move as one.

The adjustment provided by the selective relative movement between the alignment cap 44 and the rotatable member 30 provides the variation and adjustability necessary to align the gate assembly 10 with the fence line 12. Because the gate assembly 10 is staked into the ground there are instances were the ground may be uneven and inconsistence. The uneven ground may require staking at an odd angle relative to the fence line. The adjustment mechanism allows for staking at an odd angle and then adjustment of the gate 10 relative to the fence to provide the desired closure and alignment.

Figure 5:
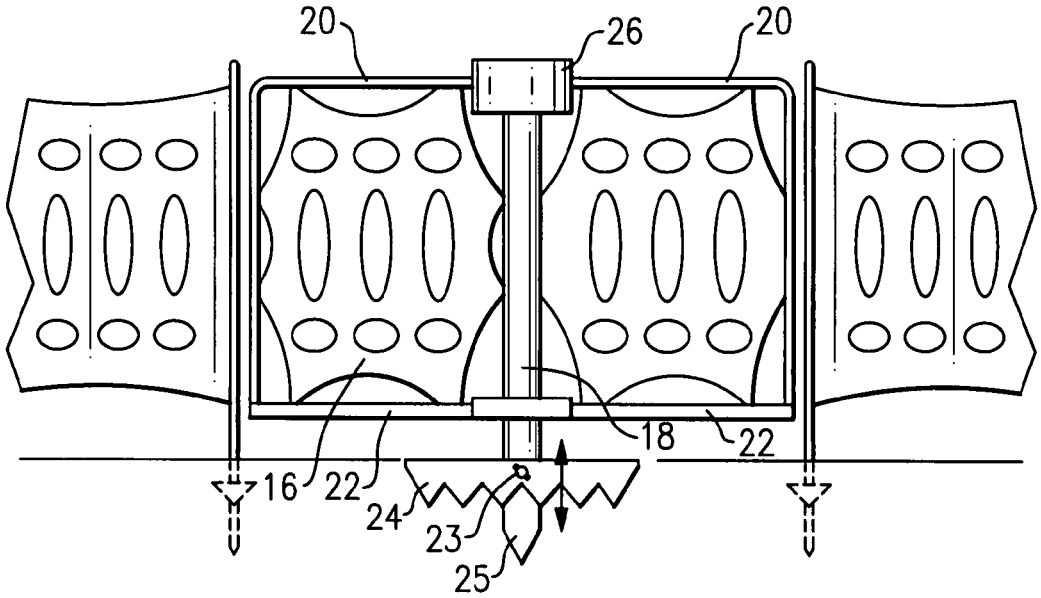
FIG. 5 is a schematic view of another example gate assembly.

Referring to FIG. 5, the mount 24 is shown as a channel including a serrated edge for staking into the ground the serrated edge provides the desired twisting prevention without required complicated and unique shapes. The mount 24 is secured to the support 18 by a fastener 23. The mount 24 is thereby movable along the support 18 to provide adjustment of the gate assembly relative to the adjacent fence posts. The support 18 also includes a pointed tip 25 that also facilitates stacking of the fence assembly 10 into the ground.

Figure 6:
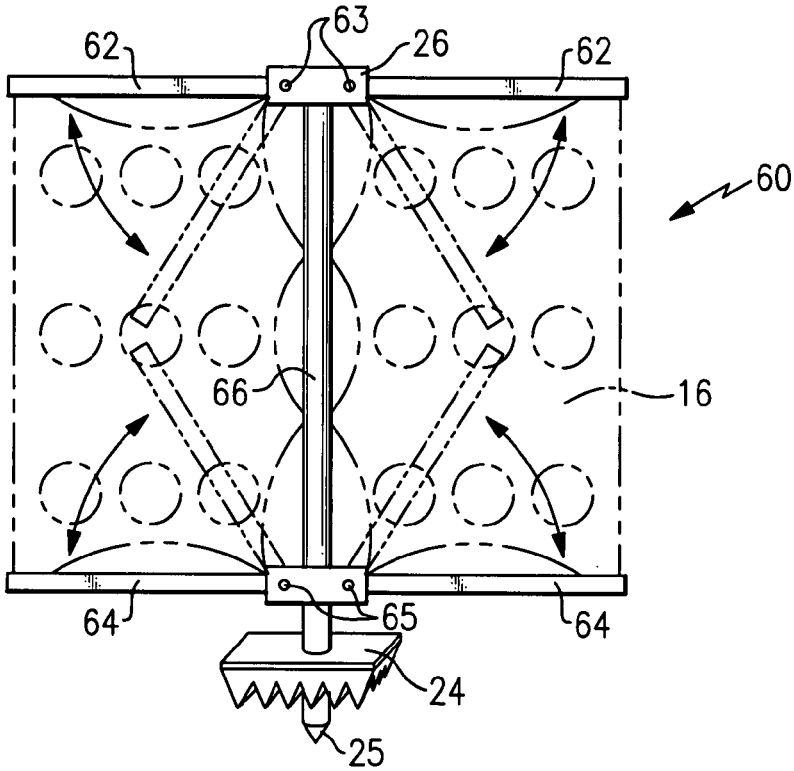
FIG. 6 is a schematic view of yet another example gate assembly.

Referring to FIG. 6, an advantage to temporary fencing is the ease at which such fencing can be stored, transported and assembled. Storing of the flexible fencing material 16 is accomplished by folding or rolling. Similarly, the posts 14 are simply pulled and stacked until required. An example gate assembly 60 includes foldable members to provide for easy storage and transport. The upper and lower cross-beams 62, 64 are attached at pivotal attachments 63, 65 to provide folding inwardly toward the support 66. Folding of the upper and lower cross-beams 62, 64 reduce the overall package size to simplify transport and storage.

In practice, the flexible fence 12 is set up as is know to define an area in which access is limited. An opening is defined in the fence line 12 for the gate assembly 10. The gate assembly 10 is then staked within the ground at a substantially central location of the defined opening. The adjustment bolt 52 is loosened to allow relative rotation between the rotatable member 36 and the adjustment cap 44. The cap 44 and thereby the cross members are rotated into alignment with the defined fence line and the adjustment bolt 52 tightened. Entry and exit through the fence 12 is then accomplished by pushing one end of the gate to rotate the gate on the ball bearing 46 about the fixed support.

Figure 7:
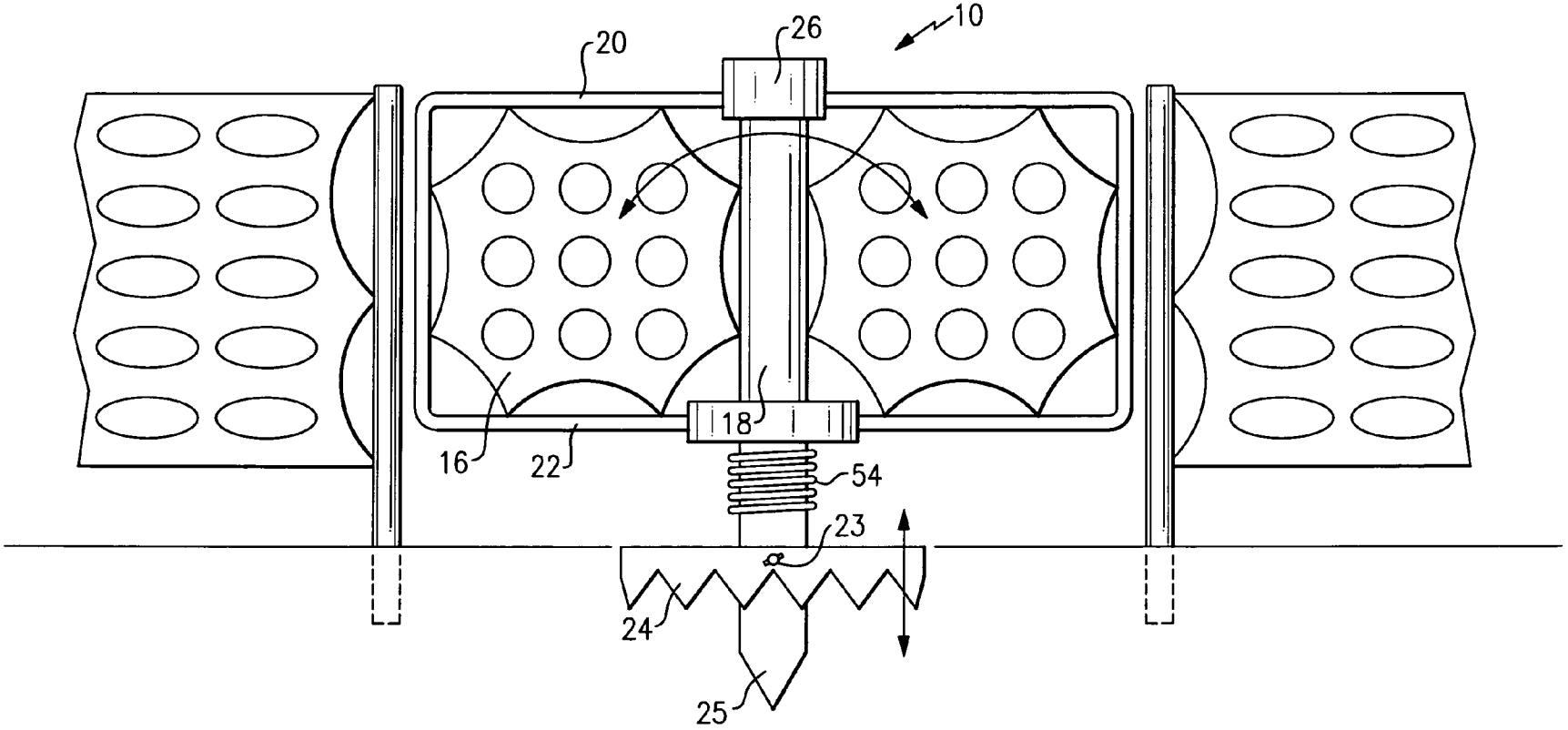
FIG. 7 is a schematic view of still another example gate assembly.

Referring to FIG. 7 the gate assembly 10 is provided with a biasing member 54 to compensate and provide for tilting of the support 18. The example biasing member 54 is a coil spring that is substantially rigid to hold the gate assembly 10 upright. The application of force on the gate assembly 10 in a direction other than to open turn the gate about the support 18 can cause a tilting of the gate assembly 10. Frequent tilting of the gate can disturb alignment and loosen the mount 24 within the ground. However, the biasing member 54 provides for this tilting such that permanent mis-alignment does not result. Once a force that causes the tilting of the gate is released, the support 18 will spring back to the desired straight and aligned position with the adjacent fence. The biasing member 54 bends so that the tilting movement is substantially isolated from the mount 54. Although the illustrated example includes a coil spring, other known devices that provide for movement while returning the support 18 to a desired aligned position.

As appreciated, an example embodiment of the temporary gate assembly has been disclosed and described. Other variations, such as mounting a panel or other device to the support for rotation are also within the contemplation of this invention. Further, other materials as are utilized for fencing are also within the contemplation of this invention.

Although a preferred embodiment of this invention has been disclosed, a worker of ordinary skill in this art would recognize that certain modifications would come within the scope of this invention. For that reason, the following claim should be studied to determine the true scope and content of this invention.

What is claimed is:

1. A temporary gate assembly comprising:

a support defining a rotational axis;

a mount attached to the support and removably insertable within the ground for holding the support in a desired upright position;

a rotation mechanism that is supported atop the support;

at least one top cross-member extending from the rotation mechanism;

at least one bottom cross-member extending horizontally from a support bearing rotatable about the support to facilitate rotation about said rotational axis; and a flexible fencing material attached to the at least one top cross-member and at least one bottom cross-member, wherein at least one of the top cross-member and the bottom cross-member are rotatable away from a horizontal position towards said support about a pivotal axis transverse to the rotational axis such that the at least one of the top cross-member and the bottom cross-member is capable of being rotated to a folded position to provide for easy storage and transport.

2. The gate assembly as recited in claim 1, wherein the rotation mechanism includes a ball bearing supported atop a post supported atop the support, wherein the ball bearing is centered along an axis of rotation of the gate assembly.

3. The gate assembly as recited in claim 2, wherein the rotation mechanism includes a sleeve disposed over the ball bearing and the post that is rotatable relative to the support and the post.

4. The gate assembly as recited in claim 3, including a rotatable member attached to the sleeve for rotation relative to the post and the support, wherein the rotatable member defines an inner space within which the post, sleeve and ball bearing are disposed.

5. The gate assembly as recited in claim 4, including an adjustment cap to which the at least one top rail is attached, wherein the adjustment cap is supported on the rotatable member and selectively securable to the rotatable member.

6. The gate assembly as recited in claim 4, including a return mechanism for automatically rotating the rotatable member to a desired position.

7. The gate assembly as recited in claim 6, wherein the return mechanism includes a biasing member having first and second arms, that engage a corresponding one of a first leg attached to the support and a second leg attached to the rotatable member for creating a bias toward the desire position.

8. The gate assembly as recited in claim 1, wherein the mount comprises at least one flat surface for insertion into the ground to prevent rotation of the support.

9. The gate assembly as recited in claim 8, wherein the flat surface is fixed to the support.

10. The gate assembly as recited in claim 1, wherein the at least one top cross-member and bottom cross-member comprise two top cross-members and two bottom cross-members that extend from either side of the support.

11. A temporary gate assembly comprising:

a support defining a rotational axis;

a mount attached to the support and removably insertable within the ground for holding the support in a desired upright position;

a rotation mechanism that is supported atop the support;

at least one top cross-member extending from the rotation mechanism;

at least one bottom cross-member extending horizontally from a support bearing rotatable about the support to facilitate rotation about said rotational axis;

a flexible fencing material attached to the at least one top cross-member and at least one bottom cross-member, and a biasing member extending from the mount to the support to accommodate tilting of the support relative to the mount and bias the support toward the desired upright position.

12. The gate assembly as recited in claim 11, wherein the biasing member comprises a coil spring.

13. The gate assembly as recited in claim 1, wherein the at least one top cross-member includes a first pivotal attachment to the rotation mechanism and the at least one bottom cross-member includes a second pivotal attachment to the support bearing.

14. A temporary gate assembly comprising:

a support defining a rotational axis;

a mount attached to the support and removably insertable within the ground for holding the support in a desired upright position;

a rotation mechanism that is supported atop the support;

at least one top cross-member extending from the rotation mechanism;

at least one bottom cross-member extending horizontally from a support bearing rotatable about the support to facilitate rotation about said rotational axis; and a flexible fencing material attached to the at least one top cross-member and at least one bottom cross-member, wherein the at least one top cross-member is rotatable about a first pivotal attachment to fold inward toward the support and the at least one bottom cross-member is rotatable about a second pivotal attachment to fold inward toward the support wherein each of the first and second pivotal attachments has an axis transverse to said rotational axis and wherein the top and bottom cross-members are capable of being rotated to a folded position to provide for easy storage and transport.

* * * * *